United States Patent [19]

Yokoo et al.

[11] 4,342,016

[45] Jul. 27, 1982

[54] TRANSFER-TYPE ELECTROMAGNETIC RELAY COMPRISING A COIL AROUND A HOUSING OF THE RELAY AND AN ARMATURE CARRYING MOVABLE CONTACTS AT BOTH ENDS

[75] Inventors: Kiyotaka Yokoo; Sadayuki Mitsuhashi; Kazutoshi Wakamatsu, all of Tokyo, Japan

[73] Assignee: Nippon Electric Co., Ltd., Tokyo, Japan

[21] Appl. No.: 179,269

[22] Filed: Aug. 18, 1980

[30] Foreign Application Priority Data

| | | | |
|---|---|---|---|
| Aug. 20, 1979 | [JP] | Japan | 54-105796 |
| Aug. 20, 1979 | [JP] | Japan | 54-105797 |
| Nov. 8, 1979 | [JP] | Japan | 54-144698 |
| Nov. 8, 1979 | [JP] | Japan | 54-144699 |

[51] Int. Cl.[3] ..... H01H 50/04; H01H 51/01; H01H 51/29

[52] U.S. Cl. ..... 335/79; 335/83; 335/84; 335/80

[58] Field of Search ..... 335/80, 79, 83, 84, 335/133, 136, 157, 229, 230, 253, 95, 97, 203, 202, 232, 234, 235, 279

[56] References Cited

U.S. PATENT DOCUMENTS

| | | | |
|---|---|---|---|
| 3,946,347 | 3/1976 | Sauer | 335/202 |
| 4,034,323 | 7/1977 | Homma | 335/133 X |
| 4,160,965 | 7/1979 | Kobler et al. | 335/79 |

*Primary Examiner*—L. T. Hix
*Assistant Examiner*—S. D. Schreyer
*Attorney, Agent, or Firm*—Laff, Whitesel, Conte & Saret

[57] ABSTRACT

In a transfer-type electromagnetic relay, movable contact studs are attached to both ends of a leaf spring (38) fixed onto an armature (39) for reducing the relay thickness. Leads (26, 27) for fixed contact studs are made of a soft magnetic material. Permanent magnets (46, 47) are placed transversely on the leads with poles of the same name brought nearer to the leads. When selectively magnetized by a coil (48) wound around a housing (21, 22), the armature is swung to carry out contact transfer with a high sensitivity. The relay is rendered self holding by the permanent magnet and the soft magnetic leads. Only one permanent magnet may be used for a current-holding relay. The leaf spring has transverse and longitudinal arms for insuring contact between the movable and fixed contact studs and connection of the movable contact studs to leads thereof.

17 Claims, 8 Drawing Figures

TRANSFER-TYPE ELECTROMAGNETIC RELAY COMPRISING A COIL AROUND A HOUSING OF THE RELAY AND AN ARMATURE CARRYING MOVABLE CONTACTS AT BOTH ENDS

BACKGROUND OF THE INVENTION

This invention relates to a transfer-type flat electromagnetic relay.

As will later be described more in detail with reference to one of nearly ten figures of the accompanying drawing, a transfer-type electromagnetic relay disclosed in Japanese Pre-patent Publication or Published Unexamined Patent Application No. Syo 53-68851 or 68851/78 comprises a housing having a first and a second end, a first and a second lead fixed to the housing adjacent to the first and the second ends, a lead pair fixed to the housing centrally between the first and the second ends with a predetermined spacing, a first and a second fixed contact stud attached to the first and the second leads, and a first and a second movable contact stud attached to both end portions of a leaf spring. A central portion of the leaf spring is welded to the lead pair so that the first and the second movable contact studs may serve as a first and a second contact in cooperation with the first and the second fixed contact studs.

A rectangular permanent magnet having a length shorter than the leaf spring, is placed on a coil wound around a flat core. An armature having a length shorter and longer than the leaf spring and the magnet and a width narrower than the predetermined spacing, is urged by the leaf spring to a hinge rod positioned transversely on the magnet for seesaw movement about an axis of the hinge rod. The core has extensions extended along end faces of the coil and longitudinal ends of the magnet near to both ends of the armature. The magnet has poles of the same name adjacent to the longitudinal ends and a common pole of the different name at the center.

When the coil is supplied with an electric current, a magnetic field appears to produce poles of names same as and different from the adjacent poles of the permanent magnet near the core extension ends. Due to a difference between attraction and repulsion given to the armature ends, one and the other of the first and the second contacts are closed and open depending on the sense of current flow. The permanent magnet is also for keeping closure of the contact even after disappearance of the magnetic field until the current is caused to flow through the coil in the reversed sense.

Because of a stack of the armature, the permanent magnet, and the coil, the relay is considerably thick. On driving the relay, an appreciable amount of the electric power is consumed because a sufficiently strong pole must be produced adjacent to the differently named pole of the permanent magnet although the other pole of the permanent magnet may augment repulsion given to the other armature end by the pole produced with the same name near the other core extension end.

SUMMARY OF THE INVENTION

It is therefore an object of the present invention to provide a transfer-type electromagnetic relay having a thinnest possible thickness.

It is another object of this invention to provide an electromagnetic relay of the type described, which can be driven by a least possible electric power.

It is still another object of this invention to provide an electromagnetic relay of the type described, which has a high sensitivity to the driving electric power.

It is readily feasible according to this invention to provide a relay array in which a plurality of relay units of the type described are arranged side by side in a compact space.

It is also readily feasible according to this invention to provide a relay arrangement in which a plurality of relay arrays of the type described are stacked one on another in a compact space.

It is possible according to an aspect of this invention to provide an electromagnetic relay of the type described, which is very stably operable even after contact transfer is repeated a great number of times.

A transfer-type electromagnetic relay to which this invention is applicable, comprises a housing and a contact assembly. The housing comprises a base member having a generally flat insulative inner surface and a cap member defining in cooperation with the inner surface a space having a predetermined height, a first and a second space end, and a space axis extended parallel to the inner surface through the first and the second space ends. The contact assembly comprises a first, a second, and a third lead member fixed to the inner surface adjacent to the first and the second space ends and between the first and the second space ends, respectively, and extended outwardly of the housing, a first and a second fixed contact stud attached in the space to a first predetermined point of the first lead member and a second predetermined point of the second lead member, respectively, an armature member in the space, and a first and a second movable contact stud carried by the armature member so as to form a first and a second contact in cooperation with the first and the second fixed contact studs, respectively. The armature member has a transverse axis transversely of the space axis and intermediately between the first and the second space ends. The armature member is held on the third lead member for seesaw movement about the transverse axis and electrically connects the first and the second movable contact studs to the third lead member. The relay further comprises energizing means for selectively electromagnetically energizing and deenergizing the armature member to carry out a transfer of contact between the first and the second contacts, and latching means for latching the armature member so as to keep at least a predetermined one of the first and the second contacts closed while the armature member is left deenergized.

According to this invention, the third lead member comprises a support portion fixed intermediately between the first and the second space ends to the inner surface and a lead portion extended from the support portion towards at least a predetermined one of the first and the second space ends and further extended outwardly of the housing. The first lead member comprises a first inner portion fixed to the inner surface between the support portion and the first space end and a first outer portion extended from the first inner portion outwardly of the housing. The second lead member comprises a second inner portion fixed to the inner surface between the support portion and the second space end and a second outer portion extended from the second inner portion outwardly of the housing. The first and the second lead members have a first elongated portion comprising the first inner portion and a second elongated portion comprising the second inner portion, respectively. Each of the first and the second elongated portions is made of a predetermined material having a predetermined magnetic property and extended parallel to the space axis.

The armature member comprises an armature, an electroconductive leaf spring, and connecting means for electrically connecting the leaf spring to at least predetermined one of the support and the lead portions. The armature has the transverse axis and is mounted on the support portion for the seesaw movement. The leaf spring comprises a central portion fixed onto the armature and a first and a second extensions extended from the central portion transversely of the transverse axis towards the first and the second space ends, respectively. The first and the second movable contact studs are attached to the first and the second extensions, respectively.

The energizing means comprises a coil wound around the housing and means for electrically selectively energizing the coil to produce a magnetic field in the space in a direction of the space axis with a preselected one of a first and a second sense of the direction of magnetically energizing the armature so as to produce a north and a south pole adjacent to an armature end nearer to the first contact, respectively, and for electrically deenergizing the coil to make the magnetic field disappear and thereby to magnetically deenergize the armature.

Inasmuch as the coil is wound around the housing, the armature is directly magnetically energized and deenergized. This considerably reduces the driving electric power. Furthermore, this appreciably reduces the thickness of the relay in addition to the fact that the movable contact studs are carried by the armature at both ends. As will later be described, it is possible to make the latching means give a strong torque to the magnetically energized armature. This raises the sensitivity of the relay. It is readily possible to adapt the latching means to either of a current holding and a self holding relay. Other features of relays according to this invention will become clear as the description proceeds.

BRIEF DESCRIPTION OF THE DRAWING

FIG. 2, is a fragmentary perspective view of a lead member frame for use in manufacturing the relay depicted in FIG. 3;

DESCRIPTION OF THE PREFERRED EMBODIMENTS

Figure 1:
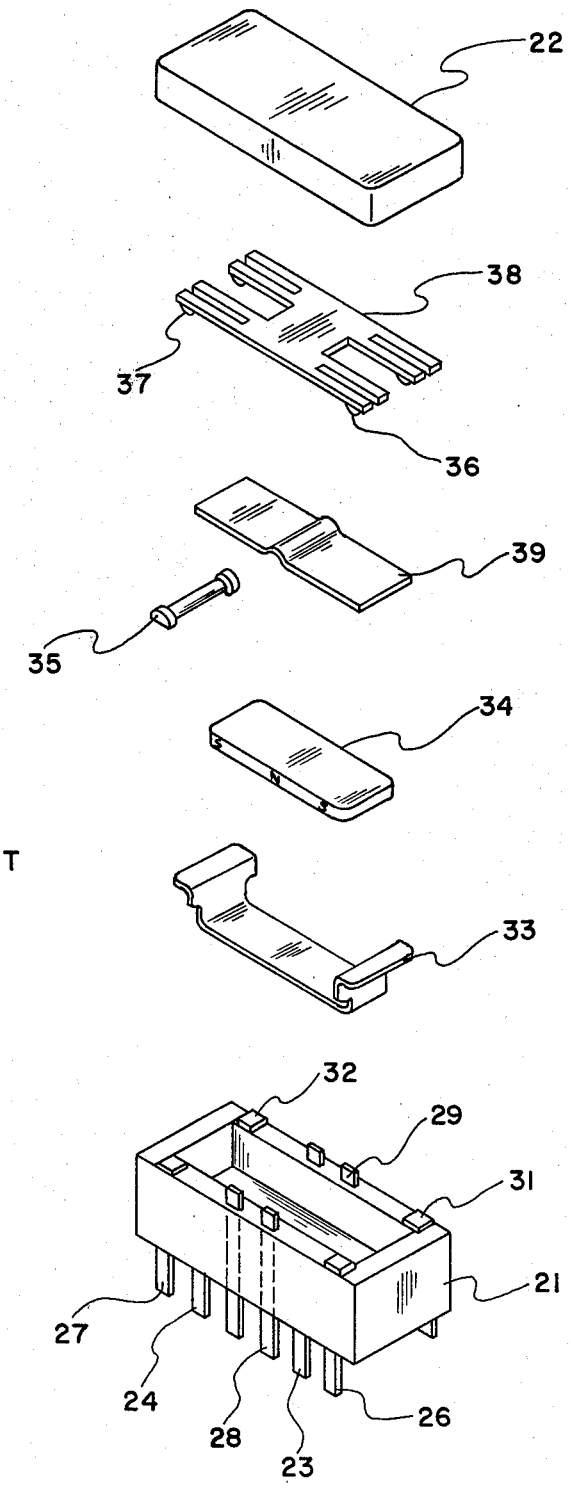
PRIOR ART FIG 1
FIG. 1 is a perspective exploded view of a conventional transfer-type electromagnetic relay revealed in Japanese Pre-patent Publication No. 68851/78 referred to hereinabove.

Referring to FIG. 1, a conventional transfer-type electromagnetic relay will be described at first in order to facilitate an understanding of various salient features of relays according to the present invention. FIG. 1 is a substantial reproduction of FIG. 1 in Japanese Pre-patent Publication No. 68851/78 cited hereinabove.

The conventional relay comprises a housing comprising, in turn, a base member 21 having a bottom, a pair of end walls, and a pair of side walls. A cap member 22 of the housing is for enclosing various relay elements in a space formed in cooperation with the base member 21. Coil terminals 23 and 24 are extended through one of the side walls. First and second lead members 26 and 27 are extended through one of the side walls from the top surface thereof downwards and outwardly of the base member 21. Corresponding lead members are likewise extended through the other side wall. A pair of lead members 28 and 29 are extended through the respective side walls. First and second fixed contact studs are attached to the first and the second lead members as indicated on top ends of the corresponding lead members at 31 and 32.

A coil is wound around a core 33 having a flat rectangular cross-section. The core 33 with the coil and a rectangular permanent magnet 34 are put in the base member 21 with extensions of the core 33 extended along end faces of the coil and longitudinal ends of the magnet 34, slightly upwardly of the base member 21. A pair of rooms are left between the core extensions and the adjacent end walls, in which the coil terminals 23 and 24 have free ends. Both ends of the coil is connected to the coil terminals 23 and 24. The rooms are filled with an impregnation material. The magnet 34 has poles of the same name (for example, south poles) near the respective longitudinal ends and a common pole of the different name at the center. A hinge rod 35 is positioned on the magnet 34 transversely on the common pole.

First and second movable contact studs 36 and 37 are attached to both ends of an electroconductive leaf spring 38 having a length appreciably longer than the permanent magnet 34. In the illustrated example, the leaf spring 38 comprises a generally square center portion and a pair of extensions extended from each longitudinal end of the central portion. Corresponding movable contact studs are attached to both ends of the paired extensions. In any event, the first and the second movable studs 36 and 37 are positioned so as to mate with the first and the second fixed contact studs 31 and 32 and thereby to form a first and a second contact, respectively.

An armature 39 has a length shorter and longer than the leaf spring 38 and the permanent magnet 34 for the reason that will become shortly clear. With the armature 39 put on the hinge rod 35, both side ends of the central portion of the leaf spring 38 are welded to the lead member pair 28 and 29. The base member 21 thus holds the armature 39 swingably about a transverse axis defined by the hinge rod 35.

For convenience of the further description, the longitudinal ends of each of the armature 39, the permanent magnet 34, and the core extensions will be called a first and a second end when the ends nearer to the first and the second contacts are under consideration. Depending on the circumstances, the armature 39 is made to rest on one of the first and the second core extension ends by the permanent magnet 34.

When the coil is supplied with an electric current to produce a north and a south pole adjacent to the first and the second core extension ends, forces applied to the armature 39 are weaker and stronger at the first and the second armature ends. A torque is therefore applied to the armature 39 to swing the same about the transverse axis. The first contact is open and the second contact, closed. Contact is thereby transferred from the first contact to the second. Even after disappearance of the poles produced by the coil, the second contact is kept closed by the permanent magnet 34. The first and the second contacts are closed and open only when the electric current is caused to flow through the coil in the reversed sense. The relay is therefore self holding.

Figure 2:
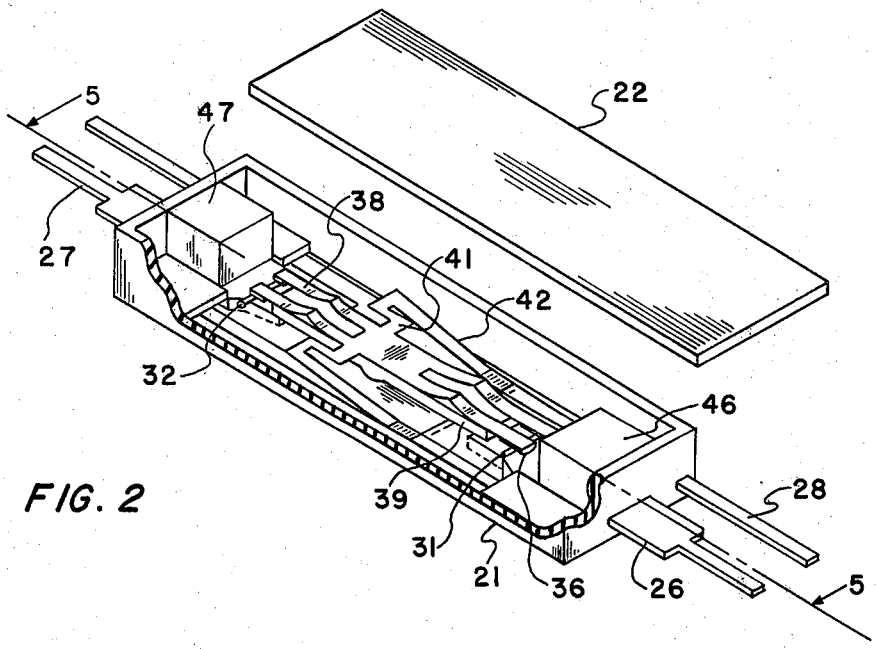
FIG. 2 schematically shows a perspective view of a transfer-type electromagnetic relay according to a first embodiment of the instant invention, with parts cut away.

Referring now to FIG. 2, a transfer-type electromagnetic relay according to a first embodiment of the present invention is a self-holding relay for a make and a break contact pair. Similar parts are designated by like reference numerals throughout the accompanying drawing figures. The relay is illustrated with a coil, a portion of the base member 21, and coil terminals removed. The cap member 22 is depicted at a position put away from the base member 21. The base member 21 has a generally flat insulative inner surface at the bottom. Side walls of the base member 21 are merely for keeping the cap member 22 in a position such that a space is defined in the housing with a predetermined height. First through third lead members 26, 27, and 28 are fixed to the inner surface as will presently be described and are extended outwardly of the housing. End walls may be used for insuring fixation of the lead members 26 through 28 to the inner surface. Ends of the space contiguous to the end walls through which the first and the second lead members 26 and 27 are led out, will be called a first and a second space end. An axis running parallel to the inner surface and through the first and the second space ends will be named a space axis.

Figure 3:
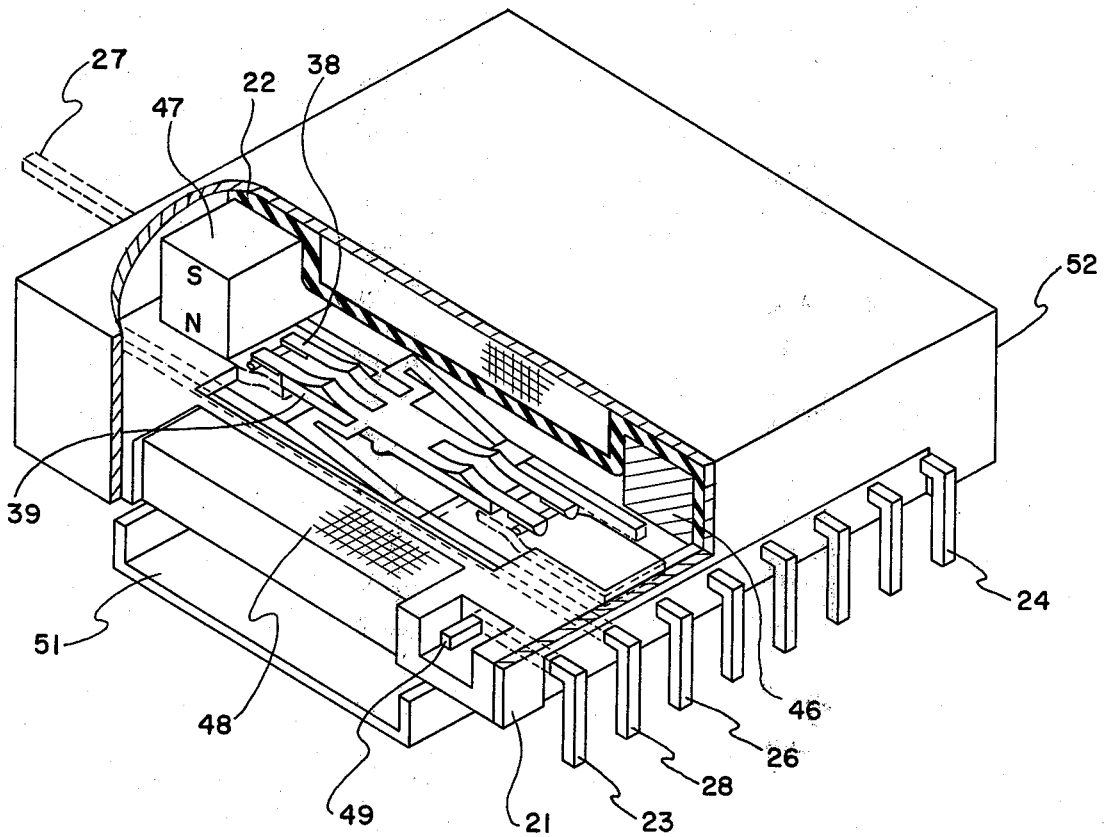
FIG. 3 shows a schematic perspective view of a transfer-type electromagnetic relay according to a second embodiment of this invention, with parts cut away.

Referring to FIG. 3, a transfer-type electromagnetic relay according to a second embodiment of this invention is an array in which a plurality of relay units of the type illustrated in FIG. 1 are arranged side by side. Coil terminals are depicted at 23 and 24. The base and the cap members 21 and 22 are partially cut away.

Figure 4:
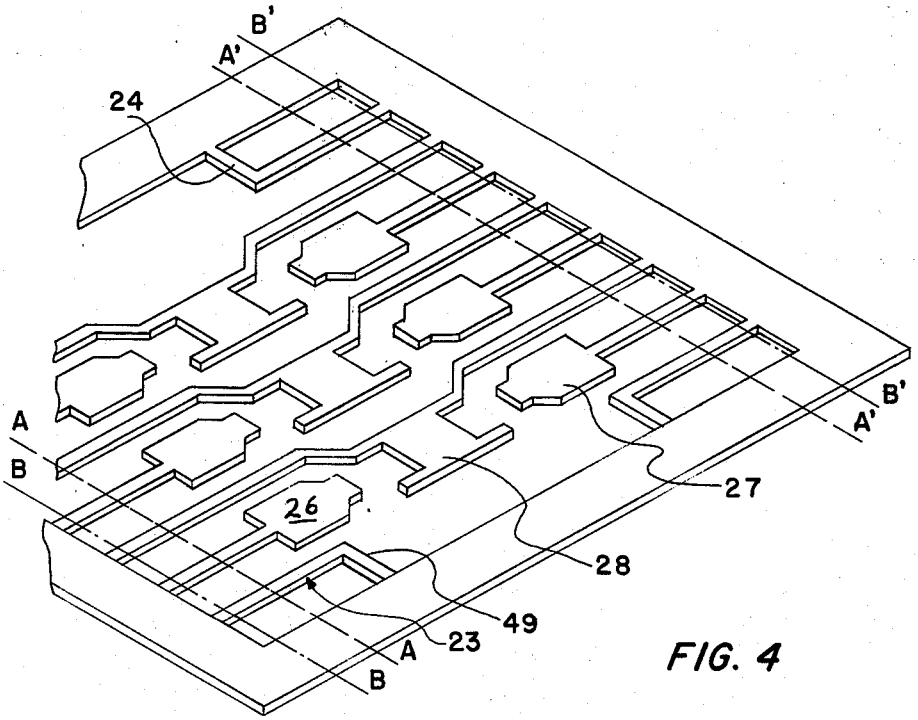
FIG. 4, drawn below

Turning to FIG. 4 for a short while, a plurality of first through third lead members, such as 26 to 28, are preferably punched from a sheet of conductive material in a form of a lead member frame for use in manufacturing the relay array depicted in FIG. 3 together with coil terminals, such as 23 and 24. Each lead member has a support portion and a lead portion extended from the support portion parallel to the space axis towards at least one of the first and the second space ends. At least the support portions of the first and the second lead members 26 and 27 should be made of a predetermined metallic material having a predetermined magnetic property to be discussed later. As will become clear as the description proceeds, the lead portions of each third lead member 28 may also be manufactured by the metallic material.

When the lead member frame is insert moulded or otherwise fixed to the base member 21, the support portion of the third lead member 28 is fixed intermediately between the first and the second space ends to the inner surface. In the illustrated example, the third lead member 28 comprises a pair of lead portions extended towards and through the first and the second space ends for facilitating connection of the make and the break contacts to external circuitry. The first and the second lead members 26 and 27 are fixed intermediately between the third lead member support portion and the first and the second space ends. Support portions of the respective lead members 26 through 28 will hereafter be referred to as first through third support portions. The support portions of the first and the second lead members 26 and 27 may be called a first and a second inner portion and the lead portions, a first and a second outer portion.

Turning back to FIG. 2, first and second fixed contact studs 31 and 32 are attached to a first predetermined point of the first support portion and a second predetermined point of the second support portion. First and second movable contact studs 36 and 37 are carried by an armature member so as to form a first and a second contact in cooperation with the first and the second contact studs 31 and 32. The illustrated relay further comprises contact studs corresponding to the studs 31, 32, 36, and 37. As will be seen, the fixed contact stud and the mating movable contact stud are perpendicularly elongated so as to insure the contact against any misalignment of the contact studs.

The armature member comprises an electroconductive leaf spring 38 having a central portion and a first and a second extension extended from the central portion transversely of a transverse axis towards the first and the second space ends. The transverse axis is inherent to the armature member and extends transversely of the space axis and intermediately between the first and the second space ends. The movable contact studs 36 and 37 are attached to the extensions. An additional pair of extensions are likewise extended for the movable contact studs corresponding to the studs 36 and 37. An armature 39 made of a soft magnetic material is rectangular in outline and is held on the third support portion for seesaw movement about the transverse axis as will presently be described.

Referring more particularly to FIG. 2, the leaf spring 38 is accompanied by a pair of electroconductive transverse arms, such as 41, and a pair of electroconductive and resilient longitudinal arms, such as 42, extended parallel to the space axis. In order to augment the resiliency, each longitudinal arm has a zigzag portion. To speak of only one side of the leaf spring 38 for the time being, the transverse arm 41 has a first transverse arm end made integral with the central portion and a second transverse arm end with which a first longitudinal arm end is rendered integral. The longitudinal arm 42 has also a second longitudinal arm end. The second longitudinal arm ends are fixedly supported by the inner surface. This prevents the armature member from undesiredly moving either lengthwise or widthwise. Furthermore, at least one of the second longitudinal arm ends is electrically connected to at least one of the support and the lead portions of the third lead member 28. This insures electrical connection to the movable studs, such as 36.

The armature 39 has a ridge downwardly protruding in the figure. The ridge has a straight edge, which is put on the third support portion. The central portion is fixed onto the armature 39. In the example being illustrated, the transverse arms are aligned in parallel to the transverse axis and fixed to the central portion at positions offset relative to the straight edge in a direction of the space axis. The straight edge is therefore urged to the third support portion by the spring action of, among others, the longitudinal arms so that one and the other of the first and the second contacts may serve as the break and the make contacts, respectively. Merely for convenience of further description, it is herein presumed that the first contact is the break contact with that sense reversed contrary to the illustration in which the longitudinal arms are extended.

Although biassed as described above, the armature 39 is swingable about the straight edge for seesaw movement. The transverse axis is defined by the straight edge.

It will now be assumed that the first lead member 26 is made of a soft magnetic material either wholly or partly at least between the inner end and a point spaced a predetermined distance from the first end. Similarly, the second lead member 27 is made of a soft magnetic material either wholly or at least between the inner end and a point at a preselected distance from the second end wall. The lead parts are herein called a first and a second elongated portion.

First and second permanent magnets 46 and 47 are placed on the first and the second elongated portions. Each permanent magnet has a permanent magnet axis transversely of the space axis and a north and a south pole on both sides of the magnet axis. Poles of the same name are brought nearer to the respective elongated portions. The magnets 46 and 47 and the elongated portions associated therewith serve as latching devices as will later be detailed. Use of two magnets 46 and 47 renders the relay self holding. When a current-holding relay is desired, the relay should comprise only one of the magnets 46 and 47 that is put on the elongated portion for the fixed contact stud that forms the break contact in cooperation with the opposing movable contact stud.

As briefly described hereinabove, the relay array depicted in FIG. 3 comprises a plurality of contact assemblies in the housing. The contact assembly, as herein called, is an assembly of the structural elements of a relay unit illustrated with reference to FIG. 2. Preferably, the side walls between the relay units are omitted. This is for enabling a single permanent magnet 46 or 47 to be used in common to those first or second elongated portions of the respective contact assemblies which are coplanar.

In FIG. 3, free ends of the lead members 26 through 28 and the coil terminals 23 and 24 are bent downwards. Only one of the second lead members is depicted in a position before the bending. The downward bending is carried out after the lead member frame (FIG. 4) is fixed to the base member 21 along lines A-A and A'-A' (FIG. 4). The leads 23-24 and 26-28 are separated from one another by afterwards cutting the lead member frame along lines B-B and B'-B'.

The cap member 22 has a pair of upward projections contiguous to the first and the second space ends. This is merely for receiving the permanent magnets 46 and 47 and also for defining end faces of a coil 48. Each coil terminal, such as 23, has a sideward bend 49 (also in FIG. 4). This is for facilitating connection of the coil winding ends to the coil terminals 23 and 24. The base member 21 has a pair of downward projections, each having a lengthwise outside surface along the space end and a lengthwise inside surface spaced slightly apart from the coil end face. A pair of thin plates (not shown) brought into contact face to face with the inside surfaces will facilitate the coil winding.

A pair of gaps formed between the base member protrusion inside surfaces and the coil end faces is for receiving end extensions of a yoke 51. The yoke 51 has a yoke plate connecting the yoke extensions and covering that peripheral surface of the coil 48 which is farther from the cap member 22 than from the base member 21. In order that the outside surface of the yoke plate be flush with those outside surfaces of the base member protrusions which are parallel to the inner surface, the base member protrusions are preferably higher than the cap member protrusions.

In FIG. 3, the cap member 22 with the coil 48 is covered by a cover 52. It is preferred that the cover 52 should serve also as a yoke. The yoke 52 has a pair of yoke extensions covering the first and the second space ends except for portions from which the lead members and the coil terminals, such as 23 and 24 and 26 through 28, are extended outwardly of the base member 21. The yoke 52 may or may not have a slide extension that covers one or each of side surfaces of the base and the cap members 21 and 22 and the coil 48.

Figure 5:
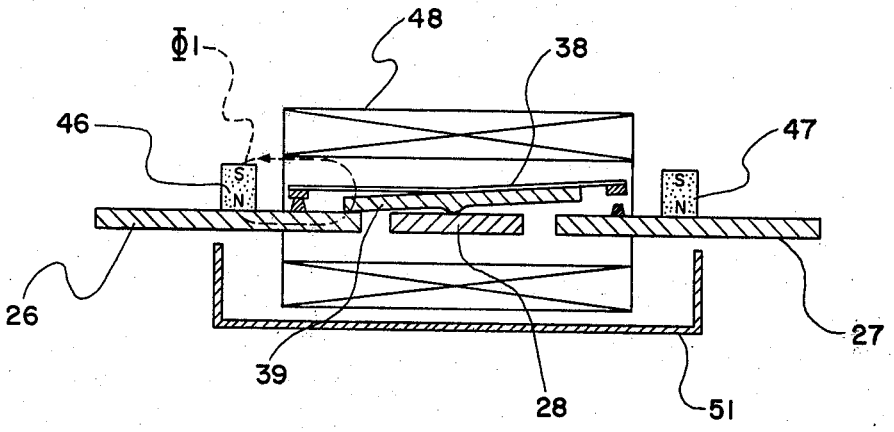
FIG. 5 schematically shows an axial sectional view taken on a line 5—5 indicated in FIG. 1, with the relay put in a rest state.
Figure 6:
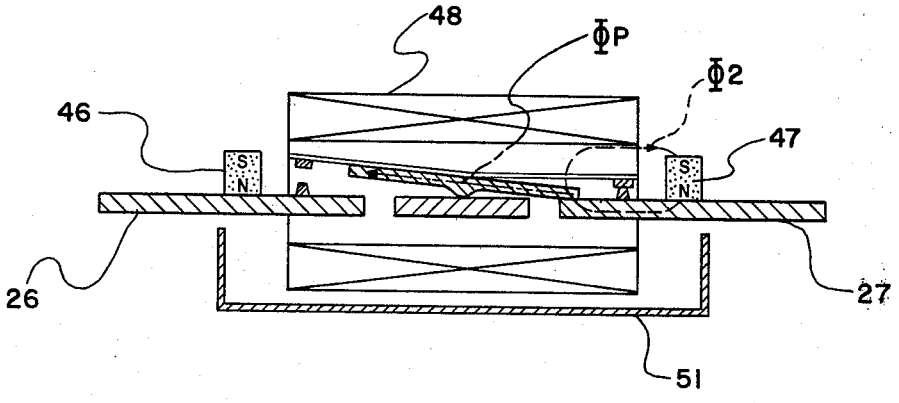
FIG. 6 shows the axial sectional view illustrated in FIG. 5, with a magnetic field produced along an armature of the relay with a sense from right to left in the figure.

Turning to FIGS. 5 and 6, the coil 48 is controllably supplied with an electric current. Thus electrically selectively energized, the coil 48 produces a principal magnetic field primarily in the direction of the space axis with a predetermined one of a first sense of magnetically energizing the armature 39 to produce a north pole adjacent to the first end (FIG. 6) and a second sense of producing a south pole near the first end. The principal magnetic field is indicated by principal magnetic fluxes $\Phi_p$. It is surmised without loss of generality that the north poles N's of the first and the second permanent magnets 46 and 47 are brought nearer to the elongated portions of the first and the second lead members 26 and 27.

In FIG. 5, the coil 48 is electrically deenergized. As described, it is supposed that the first contact is a break contact. A first local magnetic field $\Phi_1$ produced by the first permanent magnet 46 insures closure of the first or break contact.

In FIG. 6, the electric current is caused to flow through the coil 48 to direct the principle magnetic fluxes $\Phi_p$ through the armature 39 as indicated by a line with an arrowhead. During the current flow, the armature 39 is magnetized so that a north and a south pole may appear adjacent to the first and the second permanent magnets 46 and 47. A repulsive force is applied to the first end of the armature 39 by cooperation of the magnetized armature 39 with the first permanent magnet 46. Attraction is applied to the second end of the armature 39 by the magnetized armature 39 and the second permanent magnet 47. The permanent magnets 46 and 47 thus serve in applying a torque to the armature 39 for contact transfer. The first contact is open and the second contact, closed. The sense of the principal magnetic field illustrated by the fluxes $\Phi_p$ is the first sense.

Once closed, the second contact is kept closed by a second local magnetic field $\Phi_2$ produced by the second permanent magnet 47 even after electrical deenergization of the coil 48. In order to let the first contact close, it is necessary to supply the coil 48 with an electric current in the reversed sense.

It is readily possible to render the relay current-holding. This is carried out by using only one of the first and the second permanent magnets 46 and 47. Preferably, the only one permanent magnet used in a current-holding relay should be that illustrated in FIGS. 2 and 3 adjacent to the break contact. In a current-holding relay, it is mandatory that at least that one of the first and the second contact member elongated portions be made of a soft magnetic material on which the only one permanent magnet is put. The second contact is closed only while the principal magnetic field is produced in the first sense.

Reverting to FIGS. 2 and 3, it is feasible to dispense with the permanent magnet or magnets 46 and 47. This is rendered possible by manufacturing, for a self-holding relay, the first and the second lead member elongated portion by the use of a magnetic material that is not ferromagnetic. More specifically, the magnetic material to be used should have a coercive force such that the elongated portion, once magnetized in either of the senses by the magnetic field produced by the coil 48, should keep the residual or remanent magnetism against disturbing magnetic fields until the magnetic field is applied by the coil 49 to the elongated portion in the reversed sense. Due to the coercive force, the sense of the magnetic field in the elongated portions is reversed with a short delay. For a current-holding relay, the magnetic material should be used in manufacturing only that one of the elongated portions which is, preferably, nearer to the break contact.

In FIGS. 5 and 6, let it be supposed that the permanent magnets 46 and 47 are removed and that the first and the second lead members 26 and 27 are wholly made of the magnetic material specified above. During the time that the armature 39 is magnetized as indicated in FIG. 6 by the magnetic fluxes $\Phi_p$, the lead members 26 and 27 are also magnetized. South and north poles appear adjacent to inner ends of the first and the second lead members 26 and 27 with the delay, respectively. Due to the difference in the distances between the lead member poles and the adjacent armature poles, the armature 39 is kept in the illustrated position during the electric energization of the coil 48.

Even after deenergization of the coil 48, the magnetism is remanent until the armature 39 is magnetized in the reversed sense. Before lapse of the short delay, the south and the north poles remain in the first and the second lead member inner ends. A south and a north pole appear adjacent to the first and the second ends of the armature 39. Repulsion is stronger at the second end that at the first end. The armature 39 starts to turn counterclockwise. In the meantime, the magnetic field produced by the coil 48 overcomes the coercive force. A north and a south pole appear adjacent to the inner ends of the first and the second lead members 26 and 27. The armature 39 is further swung.

Further referring to FIGS. 5 and 6, it will now be supposed that the first lead member 26 alone is made of the above-specified magnetic material and the second lead member 27, of a soft magnetic material. During magnetization of the armature 39 as specified in FIG. 6 by the use of magnetic fluxes $\Phi_p$, a south pole appears adjacent to the inner end of the first lead member 26. So long as the coil 48 is kept energized, the armature 39 remains in the position illustrated in FIG. 6 against a combination of the attraction between the first lead member inner end and the armature left end and the spring action of the leaf spring 38. As soon as the coil 48 is deenergized, the armature 39 is swung to the position shown in FIG. 5 and kept there by the spring action of the leaf spring 38 and the attraction resulting from the remanent south pole.

Let the coil 48 be energized with the armature 39 put in the rest position depicted in FIG. 5 so as to make a south and a north pole appear in the armature 39 adjacent to the first and the second ends. During the short delay, the south pole is remanent in the first lead member 26. The repulsion overcomes the spring action of the leaf spring 38. The armature 39 starts a clockwise swing. The second lead member 27 is attracted relative to the armature 39, which is further swung clockwise against the spring action and the attraction between the south pole in the armature 39 and the north pole that now appears in the first lead member 26 to be remanent there. It is necessary that the coil 48 should be energized with the sense of the exciting current successively reversed, on breaking and closing the break and the make contacts, respectively.

Figure 7:
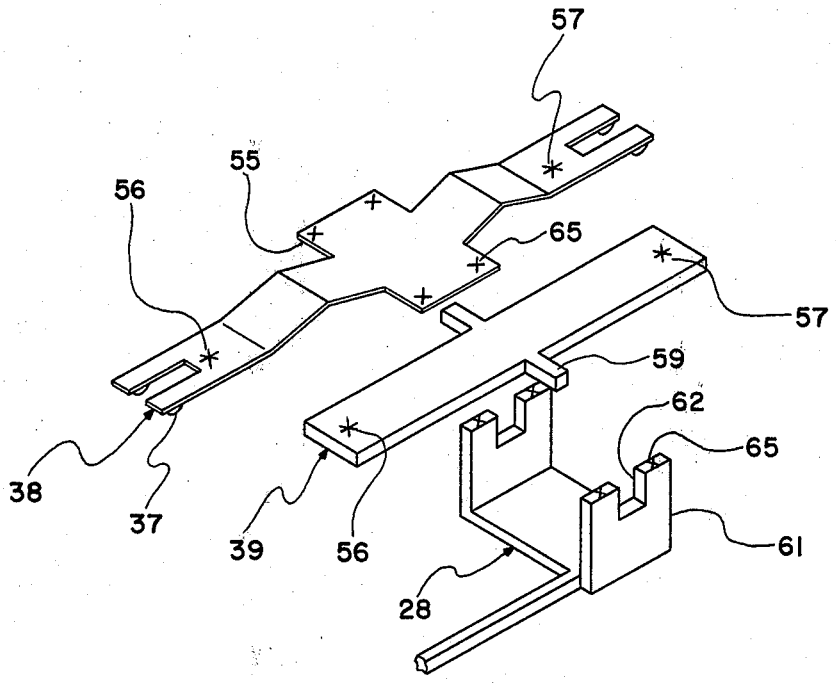
FIG. 7 is a schematic perspective view of an armature member and a portion of a lead member therefor for use in a transfer-type electromagnetic relay according to a third embodiment of this invention.

Referring to FIG. 7, a transfer-type electromagnetic relay according to a third embodiment of this invention is similar in structure to any one of the relays illustrated with reference to FIGS. 2 through 6 except for a portion to be described in the following. As implemented by the transverse and the longitudinal arms, the armature member is kept aligned with the space axis.

The leaf spring 38 has a pair of side extensions 55 on both sides of the central portion. The leaf spring 38 is welded to the armature 39 at areas 56 and 57. The armature 39 has a pair of side extensions 59 along the transverse axis.

In order to hold the armature 39 swingably about the transverse axis and to provide electrical connection between the movable contact studs 37 and the third lead member 28, a pair of electroconductive plate members 61 is made integral with the third support portion. More particularly, each plate member 61 has a first and a second end surface. A notch 62 is extended from the first end surface to the second end surface. The second end surfaces, as herein called, may be interfaces along which a conductive plate is bent into a U shape. The plate members 61 should be so spaced that the armature 39 is swingable. The notches 62 are for snugly receiving the protrusions 59. The side members 55 are welded to the first end surfaces at points 65.

Figure 8:
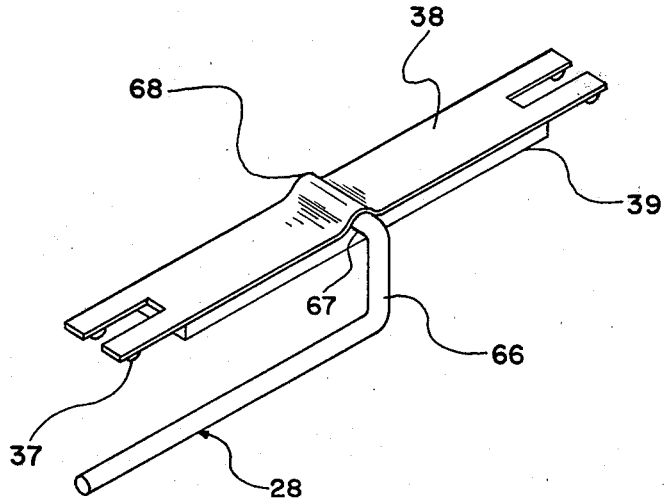
FIG. 8 is a schematic perspective view of an armature member and a portion of a lead member therefor for use in a transfer-type electromagnetic relay according to a fourth embodiment of this invention.

Finally referring to FIG. 8, a transfer-type electromagnetic relay according to a fourth embodiment of this invention is again similar to each of the relays so far illustrated with reference to FIGS. 2 through 6. The difference is as follows.

The third support portion is of a rod shape and has an upright portion 66 and a sideward extension 67 extended along the transverse axis. The sideward extension 67 serves as an axle for the seesaw movement of the armature member and provides the electrical connection. With an outwardly convex portion 68 formed to snugly receive the axle 67, the leaf spring 38 is fixed onto the armature 39 with the axle 67 interposed.

While this invention has thus far been described in specific connection with a few preferred embodiments thereof and various modifications, it will now be clear to those skilled in the art to put this invention in practice in various other manners. Above all, a plurality of contact assemblies may be stacked one on another in the housing because of the thin thickness of the contact assemblies. As is well-known in the art, each of the first and the second extensions of the leaf spring 38 may be bifurcated to carry additional movable contacts with an equal number of fixed contact studs attached to each of the first and the second support portions. The cap member 22 may be made of whichever of a dielectric material or a paramagnetic metal. It is necessary to use insulative films or sheets here and there, for example, between the lead members of a plurality of contact assemblies and a permanent magnet used in common to the lead members although an insulative sheet is unnecessary here when a magnet is used individually for each elongated portion.

Examples of the magnetic materials having the coercive force specified above, are alloys of vanadium, cobalt, and iron known as Vicalloy 1 (9% V, 52% Co, balance Fe), Vicalloy 2 (14% V, 52% Co, balance Fe), and Remendur (4% V, 48% Co, balance Fe) (the percentages being by weight). A typical relay manufactured as illustrated with reference to FIG. 3 with four contact assemblies enclosed with a housing, is 21 mm long, 28 mm wide, and 7 mm high (except for the lead member portions extended downwardly outwardly of the base member 21). When the cover 52 is used as the yoke in addition to the yoke 51, the relay is sensitive to a relay exciting current of 20 ampere-turns.

What is claimed is:

1. In a transfer-type electromagnetic relay comprising a housing and a contact assembly, said housing comprising a base member having a generally flat insulative inner surface and a cap member defining in cooperation with said inner surface a space having a predetermined height, a first and a second space end, and a space axis extended parallel to said inner surface through said first and said second space ends, said contact assembly comprising a first, a second, and a third lead member fixed to said inner surface adjacent to said first and said second space ends and between said first and said second space ends, respectively, and extended outwardly of said housing, a first and a second fixed contact stud attached in said space to a first predetermined point of said first lead member and a second predetermined point of said second lead member, respectively, an armature member in said space, and a first and a second movable contact stud carried by said armature member so as to form a first and a second contact in cooperation with said first and said second fixed contact studs, respectively, said armature member having a transverse axis transversely of said space axis and intermediately between said first and said second space ends, said armature member being held on said third lead member for seesaw movement about said transverse axis and electrically connecting said first and said second movable contact studs to said third lead member, said relay further comprising energizing means for selectively electromagnetically energizing and deenergizing said armature member to carry out transfer of contact between said first and said second contacts, and latching means for latching said armature member so as to keep at least a predetermined one of said first and said second contacts closed while said armature member is left deenergized, the improvement wherein:

said third lead member comprises a support portion fixed intermediately between said first and said second space ends to said inner surface and a lead portion extended from said support portion towards at least a predetermined one of said first and said second space ends and further extended outwardly of said housing;

said first lead member comprising a first inner portion fixed to said inner surface between said support portion and said first space end and a first outer portion extended from said first inner portion outwardly of said housing;

said second lead member comprising a second inner portion fixed to said inner surface between said support portion and said second space end and a second outer portion extended from said second inner postion outwardly of said housing;

said first and said second lead members having a first elongated portion comprising said first inner portion and a second elongated portion comprising said second inner portion, respectively, each of said first and said second elongated portions being made of a predetermined material having a predetermined magnetic property and extended parallel to said space axis;

said armature member comprising:

an armature having said transverse axis and mounted on said support portion for said seesaw movement;

an electroconductive leaf spring comprising a central portion fixed onto said armature and a first and a second extension extended from said central portion transversely of said transverse axis towards said first and said second space ends, respectively, with said first and said second movable contact studs attached to said first and said second extensions, respectively; and connecting means for electrically connecting said leaf spring to at least a predetermined one of said support and said lead portions;

said energizing means comprising:

a coil wound around said housing; and means for electrically selectively energizing said coil to produce a magnetic field in said space in a direction of said space axis with a preselected one of a first and a second sense of said direction of magnetically energizing said armature so as to produce a north and a south pole adjacent to an armature end nearer to said first contact, respectively, and for electrically deenergizing said coil to make the magnetic field disappear and thereby to magnetically deenergize said armature.

2. A transfer-type electromagnetic relay as claimed in claim 1, wherein:

said predetermined material is a soft magnetic material;

said latching means comprising a permanent magnet having a magnet axis and a north and a south pole on both sides of said magnet axis, said permanent magnet being placed on said first inner portion with said magnet axis extended transversely of said space axis and with a predetermined one of the north and the south poles of said permanent magnet brought nearer to said first inner portion, whereby only said first contact is predetermined as said at least a predetermined one of the first and the second contacts.

3. A transfer-type electromagnetic relay as claimed in claim 2, further comprising a plurality of additional ones of said contact assemblies in said housing, said permanent magnet being common to all the first inner portions.

4. A transfer-type electromagnetic relay as claimed in claim 2, wherein said latching means further comprises an additional permanent magnet having an additional permanent magnet axis and a north and a south pole on both sides of said additional permanent magnet axis, said additional permanent magnet being placed on said second inner portion with said additional permanent magnet axis extended transversely of said space axis and with one of the north and the south poles of said additional permanent magnet that is named similarly as said predetermined one of the north and the south poles brought nearer to said second inner portion, whereby said second contact is predetermined also as predetermined at least one of the first and the second contacts.

5. A transfer-type electromagnetic relay as claimed in claim 4, further comprising a plurality of additional ones of said contact assemblies in said housing, the permanent magnet and said additional permanent magnet being common to all the first inner portions and all the second inner portions, respectively.

6. A transfer-type electromagnetic relay as claimed in claim 1, wherein:

the predetermined material for said first elongated portion is a magnetic material having a coercive force such that magnetism given to said first elongated portion by the magnetic field produced in said direction with either of said first and said second senses is remanent after disappearance of the magnetic field until the magnetic field is produced in said direction with the other of said first and said second senses;

the predetermined material for said second elongated portion being a soft magnetic material;

said latching means being provided by the first elongated portion having the remanent magnetism, whereby said first contact alone is predetermined as said at least a predetermined one of the first and the second contacts.

7. A transfer-type electromagnetic relay as claimed in claim 1, wherein:

said predetermined material is a magnetic material having a coercive force such that magnetism given to said first and said second elongated portions by the magnetic field produced in said direction with either of said first and said second senses is remanent after disappearance of the magnetic field until the magnetic field is produced in said direction with the other of said first and said second senses;

said latching means being provided by the first and the second elongated portions having the remanent magnetism, whereby both said first and said second contacts are predetermined as said at least a predetermined one of the first and the second contacts.

8. A transfer-type electromagnetic relay as claimed in claims 1, 2, 4, 6, or 7, wherein said connecting means comprises:

a pair of electroconductive transverse arms, each of said transverse arms having a first and a second transverse arm end, the first transverse arm ends of said transverse arms being made integral with said central portion on both sides thereof; and a pair of electroconductive and resilient longitudinal arms, each of said longitudinal arms having a first and a second longitudinal arm end, the first longitudinal arm ends of said longitudinal arms being made integral with the second transverse arm ends, respectively, the second longitudinal arm ends being fixedly supported by said inner surface, at least one of said second longitudinal arm ends being electrically connected to at least one of said support and said lead portions.

9. A transfer-type electromagnetic relay as claimed in claim 8, wherein said at least one of the second longitudinal arm ends is fixed to said at least one of the support and the lead portion and thereby fixedly supported by said inner surface.

10. A transfer-type electromagnetic relay as claimed in claim 8, wherein said armature has a ridge having a straight edge along said transverse axis, said straight edge being urged to said support portion by a combination of said leaf spring, said transverse arms, and said longitudinal arms.

11. A transfer-type electromagnetic relay as claimed in claim 10, wherein said transverse arms are aligned in parallel to said transverse axis, said first transverse arm ends being made integral with said central portion at positions offset relative to said straight edge in a direction of said space axis to urge said straight edge to said support portion so that said first and said second contacts are made to serve as a break and a make contact, respectively.

12. A transfer-type electromagnetic relay as claimed in claim 1, 2, or 4, wherein:

said armature comprises:

a substantially rectangular armature piece elongated transversely of said transverse axis; and a pair of protrusions made integral with said armature piece on both sides thereof along said transverse axis;

said third lead member further comprising a pair of electroconductive plate members, each of said plate members having a first and a second end surface and a notch extended from said first end surface towards said second end surface, said plate members being made integral with said support portion perpendicularly thereof at the second end surfaces to swingably receive said armature piece, with said protrusions snugly received in the notches for said seesaw movement of a combination of said armature piece and said protrusions;

said connecting means comprising a pair of electroconductive side members made integral with said central portion on both sides thereof and fixed to the first end surfaces, respectively.

13. A transfer-type electromagnetic relay as claimed in claims 1, 2, or 4, wherein:

said third lead member further comprises an electroconductive rod made integral with said support portion perpendicularly thereof;

said connecting means comprising an electroconductive axle made integral with said rod along said transverse axis, said central portion being fixed onto said armature with said axle interposed for seesaw movement of said armature.

14. A transfer-type electromagnetic relay as claimed in 1, 2, 3, 4, 5, 6, or 7, wherein said energizing means further comprises a yoke comprising, in turn, a yoke plate covering said coil with said yoke plate extended parallel to said inner surface on a predetermined side of said coil and a pair of yoke extensions covering said coil parallel to said first and said second space ends, respectively.

15. A transfer-type electromagnetic relay as claimed in claim 14, wherein said energizing means still further comprises another yoke comprising, in turn, another yoke plate covering said coil with the other yoke plate extended parallel to said inner surface on the other side of said coil and a pair of other yoke extensions covering said coil parallel to said first and said second space ends, respectively.

16. A transfer-type electromagnetic relay as claimed in claim 1, further comprising a plurality of additional ones of said contact assemblies in said housing, said latching means comprising a permanent magnet being common to all the first inner portions.

17. A transfer-type electromagnetic relay as claimed in claim 2, further comprising a plurality of additional one of said contact assemblies in said housing, the permanent magnet and an additional permanent magnet being common to all the first inner portions and all the second inner portions, respectively.

* * * * *